US008667681B2

(12) United States Patent
Olivier et al.

(10) Patent No.: US 8,667,681 B2
(45) Date of Patent: Mar. 11, 2014

(54) CATALYTIC UNIT FOR TREATING AN EXHAUST GAS AND MANUFACTURING METHODS FOR SUCH UNITS

(75) Inventors: Keith Olivier, Jackson, MI (US); Ruth Latham, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 1155 days.

(21) Appl. No.: 12/616,568

(22) Filed: Nov. 11, 2009

(65) Prior Publication Data

US 2010/0143211 A1 Jun. 10, 2010

Related U.S. Application Data

(60) Provisional application No. 61/113,593, filed on Nov. 11, 2008.

(51) Int. Cl.
*B21D 51/16* (2006.01)

(52) U.S. Cl.
USPC ..... 29/890

(58) Field of Classification Search
USPC ..... 29/890
See application file for complete search history.

(56) References Cited

U.S. PATENT DOCUMENTS

| | | | | |
|---|---|---|---|---|
| 4,750,251 | A | 6/1988 | Motley et al. | |
| 4,782,661 | A | 11/1988 | Motley et al. | |
| 4,865,818 | A | 9/1989 | Merry et al. | |
| 4,969,264 | A | 11/1990 | Dryer et al. | |
| 5,293,743 | A | 3/1994 | Usleman et al. | |
| 5,787,584 | A | 8/1998 | Shea et al. | |
| 6,101,714 | A | 8/2000 | Schmitt | |
| 6,317,976 | B1 | 11/2001 | Aranda et al. | |
| 6,389,693 | B1 | 5/2002 | Aranda et al. | |
| 6,591,497 | B2 | 7/2003 | Foster et al. | |
| 6,591,498 | B2 | 7/2003 | Irie et al. | |
| 6,759,015 | B2 | 7/2004 | Peisert | |
| 6,954,988 | B2 | 10/2005 | Mayfield | |
| 7,111,392 | B2 | 9/2006 | Irie et al. | |
| 7,377,038 | B2 | 5/2008 | Bowman et al. | |
| 7,932,461 | B2 * | 4/2011 | Johnson et al. | 136/246 |
| 2001/0036427 | A1 | 11/2001 | Yamada et al. | |
| 2002/0057998 | A1 | 5/2002 | Foster et al. | |
| 2004/0052698 | A1 | 3/2004 | Sanocki et al. | |
| 2006/0024215 | A1 | 2/2006 | Kroner et al. | |
| 2006/0045824 | A1 | 3/2006 | Foster et al. | |

FOREIGN PATENT DOCUMENTS

| | | | |
|---|---|---|---|
| EP | 0 278 597 | A2 | 8/1988 |
| EP | 0 982 480 | A2 | 3/2000 |

* cited by examiner

*Primary Examiner* — David Bryant
*Assistant Examiner* — Moshe Wilensky
(74) *Attorney, Agent, or Firm* — Wood, Phillips, Katz, Clark & Mortimer

(57) ABSTRACT

A catalytic unit, a process for providing a support mat for the catalytic unit, and a process for assembling the catalytic unit are provided. An installed mat density for the support mat being calculated based upon a desired annular cross-sectional area of a gap between a catalyst carrier and a shell of the catalytic unit, with the support mat being sandwiched therebetween. The support mat for the catalytic unit can be provided by first slitting a bulk roll of support mat to form a plurality of end unit specific mat rolls. The support mat can be wrapped around the catalytic carrier to form multiple layers of support mat, with the support mat having beveled leading and trailing edges to reduce variation in material density in the layers of support mat overlying and underlying the leading trailing edges. The support mat can be free of any binder.

6 Claims, 5 Drawing Sheets

CATALYTIC UNIT FOR TREATING AN EXHAUST GAS AND MANUFACTURING METHODS FOR SUCH UNITS

CROSS-REFERENCE TO RELATED APPLICATIONS

This application claims the benefit of the filing date of U.S. Provisional Application No. 61/113,593, filed Nov. 11, 2008, which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to catalytic units for treating an exhaust gas from a combustion process, such as, for example, catalytic converters, diesel oxidation catalysts (DOC), and selective catalytic reduction catalysts (SCR) for the compression engines of automotive vehicles, and more particularly, to such catalytic units wherein a support or mounting mat is placed around an outer circumferential surface of a catalytic carrier structure for supporting the structure within a housing or shell.

BACKGROUND OF THE INVENTION

It is known in the automotive industry to include an exhaust gas treatment system utilizing one or more catalytic units, such as a catalytic converter, diesel oxidation catalyst unit, or selective catalytic reduction catalyst unit to improve the emissions in the exhaust. In such catalytic units, it is common for a catalyst to be carried as a coating on a supporting substrate structure, such as a ceramic substrate having a monolithic structure. Typically, such catalyst carriers are oval or circular in cross section and are often wrapped with a layer of a support or mounting mat that is positioned between the catalyst carrier and the outer housing or shell of the unit to help protect the catalyst carrier from shock and vibrational forces that can be transmitted from the housing to the carrier. Typically, the support or mounting mat is made of a heat resistant and shock absorbing type material, such as a mat of glass fibers or rock wool. These mats have typically been treated with a binder that improves the ability of workers to handle the mat when the mats are cut to size and during wrapping of the mat and assembly of the catalytic units. While such constructions work for their intended purpose, there is always room for improvement.

Traditionally, such constructions have involved a single layer of mat wrapped around the catalyst carrier. The mats in these constructions are formed from rolls of mat material that are first cut into sheets, and then treated with a binder before being die cut to the desired width and length for wrapping. While the process is satisfactory for its intended purpose, it produces a significant amount of scrap from the mat material (up to 30% of yield on average), requires the use of binder because of the handling required for the die cuts mats during manufacturing and assembly and requires that inventories of different part numbers be maintained for each different size and shape of die cut required for each specific catalytic unit design. FIG. 1 is an illustration of this process.

Typically in such constructions, the support mat is compressed between the outer housing or shell of the catalytic unit and the catalyst carrier in order to generate a holding force on the catalyst carrier. However, this can be difficult to maintain accurately because of variabilities in the density of the support mat as it is provided before assembly into such units. One known method of providing the desired assembled density for the support mat is to reduce the size of the housing or shell of the unit after the catalyst carrier and the support mat have been placed inside the shell, with the final outside diameter of the shell being determined based upon the desired assembled density for the support mat.

SUMMARY OF THE INVENTION

In one feature, a catalytic unit is provided for treating an exhaust gas from a combustion process. The catalytic unit includes a catalyst carrier, and at least one layer of support mat wrapped around the catalyst carrier, the support mat being free of any binder.

In another feature, a target outer shell diameter for a catalytic unit construction having a catalyst carrier wrapped in a support mat contained in the outer shell is calculated based upon the actual annular volume of the mat between the catalyst carrier and the inner diameter of the shell required to achieve the desired mat density.

As another feature, the mass/weight of the support mat for a given catalytic unit is determined indirectly by first weighing the catalyst carrier and the outer housing or shell as individual components, then weighing the entire assembled weight of the catalyst carrier, support mat and outer shell, and subtracting the weight of the outer shell and the catalyst carrier from the assembled weight.

In another feature, the yield efficiency of the support mat is improved by eliminating waste associated with the conventional die cutting process, and by reducing the inventory associated with the multiplicity of part numbers required for the conventional die cutting process. In this regard, a bulk roll of the support mat is provided on an "as-needed" or "just-in-time" basis and is slit across its width to produce a plurality of end unit specific mat rolls, with each of the end unit specific mat rolls having a width that is specific to a particular configuration or design of catalytic unit. Waste can further be cut by careful selection of the length of support mat provided on the bulk roll, or by careful selection of the length provided on each of the end unit specific support mat rolls that are slit from the bulk roll, or by careful selection of the lengths of support mat cut from each end unit specific support mat roll when producing the catalytic units associated with that end unit specific roll, or by a combination of one or more of all of the foregoing.

In another aspect, the leading and trailing edges of the support mat are cut at an angle to reduce the variation in material density that would typically occur in conventional constructions where the leading and trailing edges of the mat are overlapped or underlapped by an adjacent layer of the support mat when wrapped around a catalyst carrier.

In another aspect, the variation in mat density in the areas where the leading and trailing edges are overlapped or underlapped by an adjacent layer of support mat is reduced by optimizing the number of layers in the wrapping of the support mat around the catalyst carrier.

Other objects, features, and advantages will become apparent from a review of the entire specification, including the appended claims and drawings.

Other objects, features, and advantages of the invention will become apparent from a review of the entire specification, including the appended claims and drawings.

DETAILED DESCRIPTION OF THE PREFERRED EMBODIMENT

Figure 2:
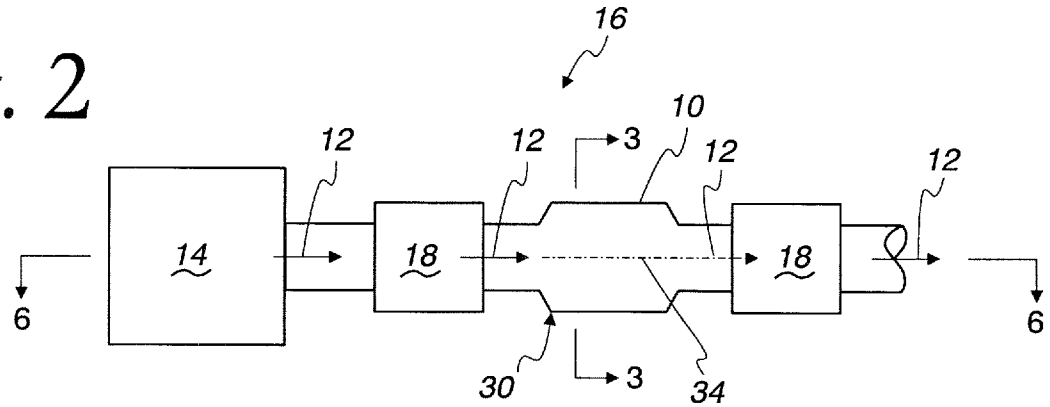
FIG. 2 is a diagrammatic representation of a combustion process and system incorporating a catalytic unit according to the invention.

With reference to FIG. 2, a catalytic unit 10 is shown for treating an exhaust gas 12 from a combustion process, such as from a combustion compression engine 14. The catalytic unit 10 is part of an exhaust gas treatment system 16, which can include other exhaust gas treatment components 18, either upstream or downstream or both from the catalytic unit 10. The components 18 can be of any suitable type and construction and can include mufflers, diesel particulate filters, injectors, and valves, such as exhaust gas recirculation valves, by way of a few examples.

Figure 3:
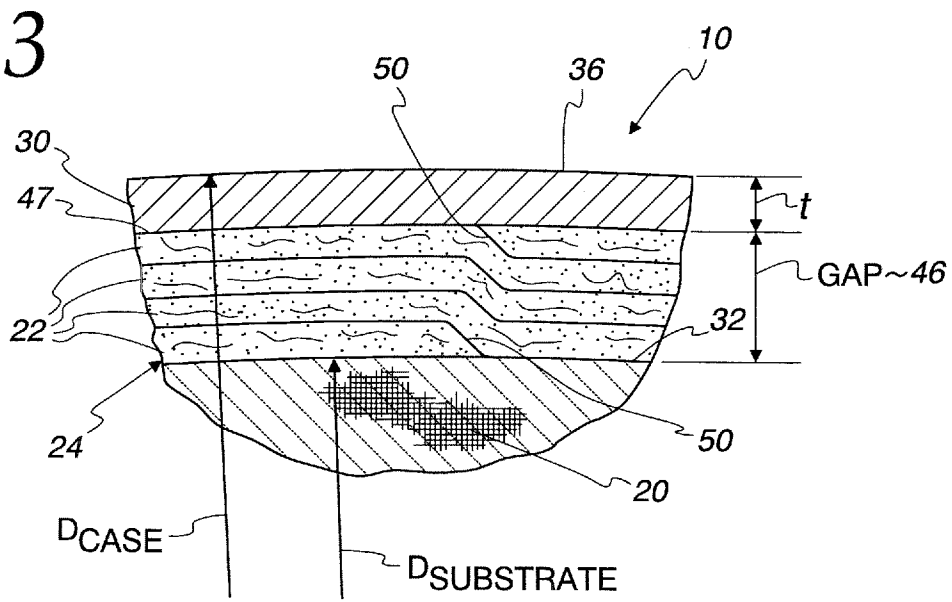
FIG. 3 is an enlarged, partial section view taken along lines 3-3 in FIG. 2.

As seen in FIG. 3, the catalytic unit 10 includes a catalyst carrier or substrate 20 and one or more layers 22 of support mat 24 wrapped around the carrier 20 and sandwiched between the carrier 20 and an outer housing or shell 30.

Figure 1:
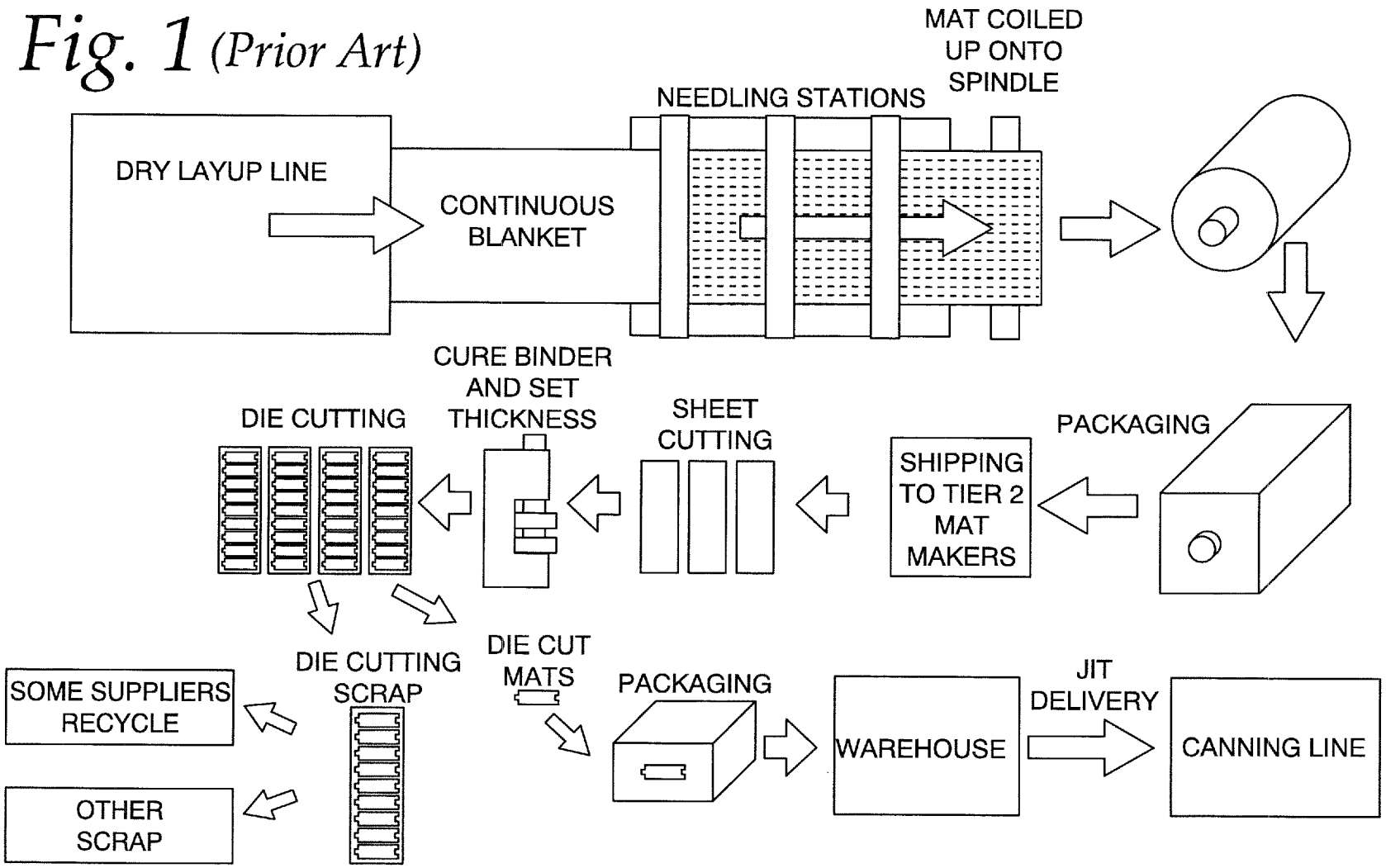
Fig. 1 (Prior Art)
FIG. 1 is a diagrammatic representation of a prior art process for providing a support mat for use in a catalytic carrier.

While the catalyst carrier 20 can be of any suitable type and construction, many of which are known, in the preferred embodiments shown in FIGS. 2 and 3, the carrier 20 is a monolithic structure of porous ceramic carrying a catalyst coating that is suitable for the intended function of the unit 10, such as, for example, a suitable oxidation catalyst or a suitable selective catalytic reduction catalyst. Preferably, the carrier 20 has an outer surface 32 that extends parallel to a longitudinal axis 34, best seen in FIG. 1, which will typically coincide with the flow direction of the exhaust 12 through the unit 10. While any suitable cross section can be used, including for example oval, elliptical, triangular, rectangular, and hexagonal, the preferred embodiments shown in FIGS. 2 and 3 have circular cross sections that are centered on the axis 34 to define a cylindrical shape for the carrier 20, the outer surface 32 and an outer surface 36 for the shell 30.

Each layer 22 of support mat 24 may be made from any suitable material, many of which are known, including, for example, glass fiber mats or rock wool mats. In one preferred form, the mat 24 is free of any binder. In this regard, it is preferred that the mat 24 be wrapped and canned in an automated process.

Figure 4:
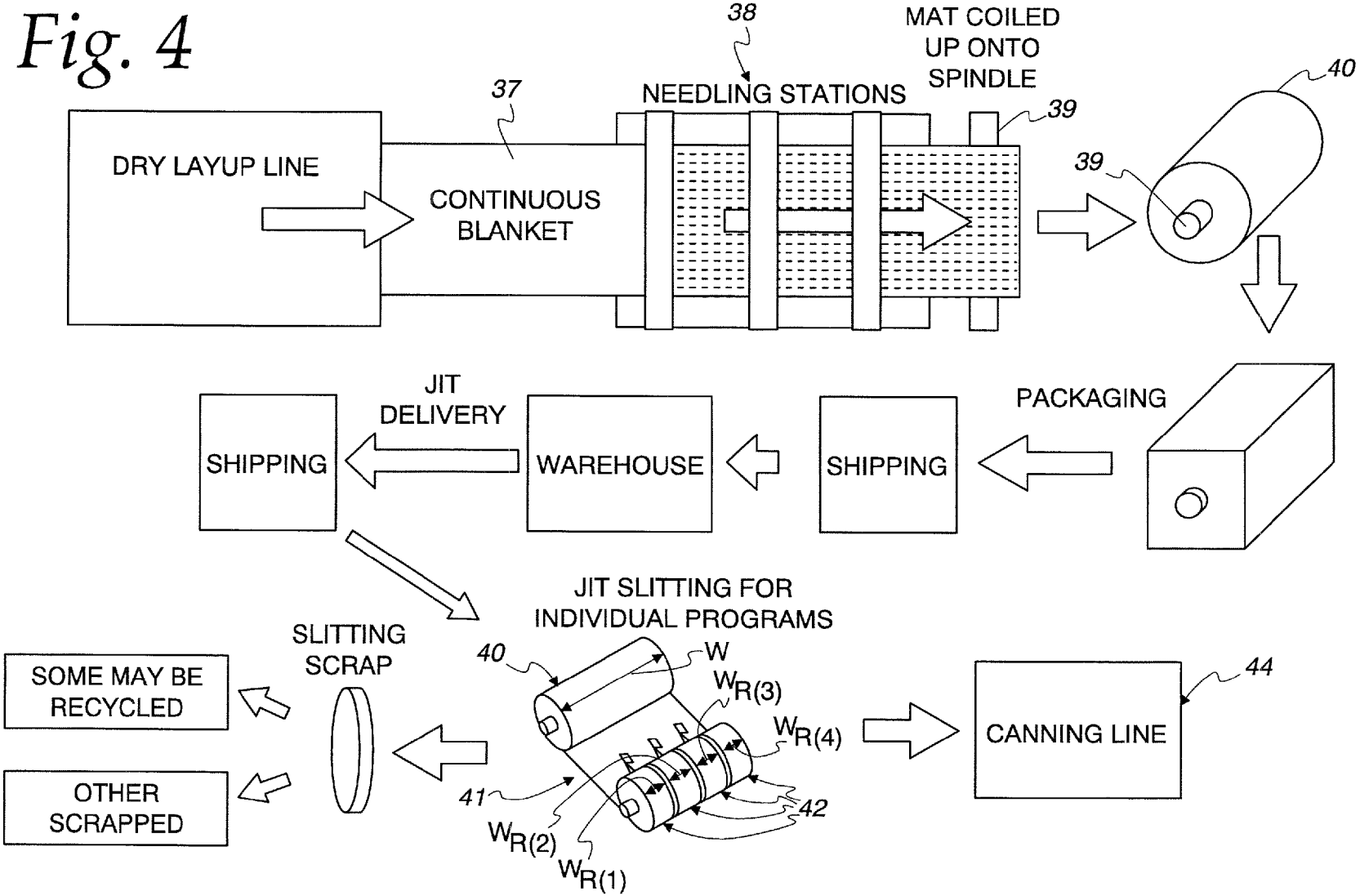
FIG. 4 is a diagrammatic representation of a process for providing support mats for use in the assembling of a catalytic unit according to the invention.

FIG. 4 illustrates an inventive method of providing a support mat for one or more specific catalytic unit designs 10. As shown in FIG. 4, a continuous blanket of support mat 37 is formed at a needling station 38 and coiled onto spindles to form bulk rolls 40 of the support mat which are then packaged and shipped for storage in a warehouse. The bulk rolls 40 are then pulled from storage by the end user on an "as-needed" or so-called "just-in-time" (JIT) basis for a slitting operation 41 wherein each bulk roll 40 is slit along its width W to form a plurality of end unit specific support mat rolls 42, with each of the end unit specific support mat rolls 42 having a width $W_{R(x)}$ that is specific to a particular configuration/design of catalytic unit 10. Preferably, no binder is used in the rolls 40 and 42 because the inventive process does not require the use of binders. Binder free material offers advantages in cost, secondary emissions, and low temperature behavior of the units 10. Once the bulk roll 40 is slit for the individual programs, the end unit rolls 42 can be provided for cutting to length and assembly of the support mat 24 onto the substrate in a canning process 44.

In one preferred form, the original width W of each of the bulk rolls 40 is selected based upon the desired widths $W_{R(x)}$ for each of the end unit support mat rolls 42 that are to be slit from the bulk roll 40 based upon an addition of the desired widths $W_{R(x)}$, with an accounting for any loss in width due to the slitting process 41. In another preferred form, the desired widths $W_{R(x)}$ to be slit from a bulk roll 40 are selected based upon the width W of the bulk roll 40 in order to minimize the scrap from the bulk roll 40 as a result of the slitting process 41. Additionally, in one form it is preferred that the length of each of the individual support mats 24 cut from an end unit support mat roll 42 be selected based upon an integer divider of the total length of the support mat in the roll 42 so as to minimize or eliminate any scrap from the roll 42. Alternatively, the total length of the original bulk roll 40 can be selected based upon a multiplier of the desired cut length for the individual support mats 24 for one or more of the units 10 that will utilize the bulk roll 40, again to minimize waste. In one preferred form, a fixed length of the support mat 24 is cut from the unit specific roll 42 to form the support mat 24 for each of the individual units 10 being assembled. As another alternative, the total length of mat on each of the unit specific rolls 42 can be selected based upon a multiplier of the desired cut length of the mat 24 for the specific unit 10 of the roll 42, again to minimize waste. In another form, to account for variances in the size of the substrate 20, rather than utilizing a fixed cut length, the length for each individual support mat 24 is calculated based on the measured diameter $D_{substrate}$ of the specific substrate 20 to which it will be wrapped so that for any particular end unit 10, the mat 24 and substrate 20 are customized to fit each other.

To illustrate some of the above concepts, a sample analysis is shown below that seeks to minimize the scrap associated with slitting a variety of support mats 24 from a bulk roll 40 having a width of 1280 mm and a length of support mat on the bulk roll 40 of either 74.2 m or 80 m. The first table illustrates the analysis wherein the length of each of the various support mats 24 is optimized to minimize scrap from the end of the length of the mat on the bulk roll 40, and the second table shows the analysis for an optimization in the width of the end unit specific rolls 42 that can be cut from the bulk roll 40.

Analysis of mat slitting yield based on mat roll length

| Substrate Diameter | Substrate Length | Mat width mm | Mat Length m | Number of slit widths/roll | Waste @ start of roll | Left over width @ end of roll | # of wraps per slit strip | Starting roll length m | Lost length in m | % loss based on length |
|---|---|---|---|---|---|---|---|---|---|---|
| 8.5 | 4 | 70 | 3.9 | 18 | 10 | 10 | 19 | 74.2 | 0.1 | 0.13% |
| 8.5 | 11 | 196 | 3.9 | 6 | 10 | 94 | 19 | 74.2 | 0.1 | 0.13% |
| 9.5 | 4 | 70 | 4.3 | 18 | 10 | 10 | 17 | 74.2 | 1.1 | 1.48% |
| 9.5 | 11 | 196 | 4.3 | 6 | 10 | 94 | 17 | 74.2 | 1.1 | 1.48% |
| 9.5 | 12 | 230 | 4.3 | 5 | 10 | 120 | 17 | 74.2 | 1.1 | 1.48% |
| 10 | 4.5 | 83 | 4.5 | 15 | 10 | 25 | 16 | 74.2 | 2.2 | 2.96% |
| 10 | 12.5 | 230 | 4.5 | 5 | 10 | 120 | 16 | 74.2 | 2.2 | 2.96% |
| 12 | 4.5 | 90 | 5.3 | 14 | 10 | 10 | 15 | 80 | 0.5 | 0.63% |
| 12 | 13.5 | 260 | 5.3 | 4 | 10 | 230 | 15 | 80 | 0.5 | 0.63% |
| 13 | 5.25 | 100 | 5.7 | 12 | 10 | 70 | 14 | 80 | 0.2 | 0.25% |
| 13 | 6.25 | 126 | 5.7 | 10 | 10 | 10 | 14 | 80 | 0.2 | 0.25% |
| 13 | 8 | 134 | 5.7 | 9 | 10 | 64 | 14 | 80 | 0.2 | 0.25% |
| 13 | 15 | 298 | 5.7 | 4 | 10 | 78 | 14 | 80 | 0.2 | 0.25% |
| 13 | 17 | 342 | 5.7 | 3 | 10 | 244 | 14 | 10 | 0.2 | 0.25% |

| Primary | Quantity of Slit widths yielded from full roll | | | | | | | | | | Final | % |
|---|---|---|---|---|---|---|---|---|---|---|---|---|
| slit width | 342 | 298 | 260 | 230 | 196 | 134 | 126 | 100 | 90 | 70 | Yield | loss |
| 342 | 3 | 0 | 0 | 1 | 0 | 0 | 0 | 0 | 0 | 0 | 1256 | 1.9% |
| 298 | | 4 | 0 | 0 | 0 | 0 | 0 | 0 | 0 | 1 | 1262 | 1.4% |
| 260 | | | 4 | 1 | 0 | 0 | 0 | 0 | 0 | 0 | 1270 | 0.8% |
| 230 | | | | 5 | 0 | 0 | 0 | 1 | 0 | 0 | 1250 | 2.3% |
| 196 | | | | | 6 | 0 | 0 | 0 | 0 | 1 | 1246 | 2.7% |
| 134 | | | | | | 9 | 0 | 0 | 0 | 0 | 1206 | 5.8% |
| 126 | | | | | | | 10 | 0 | 0 | 0 | 1260 | 1.6% |
| 100 | | | | | | | | 12 | 0 | 1 | 1270 | 0.8% |
| 90 | | | | | | | | | 14 | 0 | 1260 | 1.6% |
| 70 | | | | | | | | | | 18 | 1260 | 1.6% |

The calibrated or sized outside diameter $D_{case}$ for the case or shell 30 is preferably calculated based on a desired Installed Mat Density (IMD) which is calculated based upon the actual annular volume desired for the support mat 24 in the gap 46 between the outer surface 32 of the catalyst carrier 20 and an inner surface 47 of the shell 30 after it has been sized/calibrated. This method is contrasted with a conventional method that utilizes a Gap Bulk Density (GBD) which is also sometimes referred to as Mat Mount Density which is calculated based upon a linear or flat volume for the support mat 24. More specifically, GBD is typically calculated based upon a Basis Weight (BW) which is the mass or weight for a given width and length of support mat, which is provided in terms of mass or weight per unit area, such as, for example, $g/m^2$. The GBD is then calculated by dividing the basis weight by the gap 46.

Under the IMD method, the weight $m_{mat}$ of the mat 24 is divided by the desired IMD and the mat width $B_{mat}$ to determine the desired annular cross-sectional area $A_{gap}$ of the gap 46 between the shell 30 and the carrier or substrate 20. The cross-sectional area $A_{substrate}$ of the substrate 20 is then calculated based on the substrate diameter $D_{substrate}$ and added to the cross-sectional area $A_{gap}$ of the gap 46 to determine a target cross-sectional area $A_{case}$ for the inside diameter of the shell 30. The cross-sectional area $A_{uncalibrated}$ of the uncalibrated (undeformed) shell (case) 30 can be calculated based upon its uncalibrated (undeformed) inside diameter ID and its uncalibrated (undeformed) outside diameter OD which can in turn be calculated from the wall thickness t of the shell 30. Alternatively, the cross-sectional area $A_{uncalibrated}$ of the uncalibrated shell 30 can be calculated based upon the weight $m_{shell}$ of the shell 30, the length of the shell 30, and the density of the shell 30. It is assumed that this cross-sectional area $A_{uncalibrated}$ of the shell 30 will be maintained in the calibrated (deformed) state and accordingly the shell cross-sectional area $A_{uncalibrated}$ is added to the target cross-sectional area $A_{case}$ for the inside diameter of the shell. The target outer diameter $D_{case}$ for the calibrated (deformed) shell 30 is then calculated by taking this total area and dividing it by π and multiplying it by four (4). The equations for the IMD method are shown in detail below, together with a sample calculation:

IMD=Installed Mat Density [$kg/m^3$]

$D_{substrate}$=equivalent substrate diameter [mm]

$A_{substrate}$=cross sectional area of the substrate [$mm^2$]

$m_{mat}$=support mat weight w/o binder [g]

$A_{gap}$=cross sectional area of the gap [$mm^2$]

$B_{mat}$=support mat width [mm]

$A_{shell}$=target cross sectional surface of the shell that is to calibrate [$mm^2$]

$D_{case}$=equivalent target outer diameter/calibrated diameter of the shell [mm]

$t$=wall thickness of the shell [mm]

$V_{gap}$=gap volume [$mm^2$]

$$IMD[kg/m^3] = \frac{m_{mat}}{V_{gap}}$$

Calculation→cross sectional gap area

→$A_{gap}$=1281.53 mm$^2$

→$B_{mat}$=64 mm (according to drawing)

→IMD=437.10 kg/m$^3$ (target IMD, according to drawing)

$$A_{gap} = \frac{m_{mat}}{IMD * B_{mat}} = \frac{35.85\ \text{g}}{437,\ Ikg/\text{m}^3 * 64\ \text{mm}} = 1281.53\ \text{mm}^2$$

Calculation→target cross sectional area of the shell that is to calibrate $A_{case}=A_{substrate}+A_{gap}$=11002.7 mm$^2$+1283.53 mm$^2$=12284.24 mm$^2$ Calculation=Area of uncalibrated shell $$A_{uncalibrated}\ \frac{\pi}{4}(OD_{case}^2 - ID_{case}^2)$$

Calculation→equivalent target outer shell diameter $$D_{case} = \sqrt{\frac{4(A_{case} + A_{uncalibrated})}{\pi}}$$

Alternate calculation using shell thickness $$D_{case} = \sqrt{\frac{4 * A_{case}}{\pi}} + 2^* t = \sqrt{\frac{4 * 12284.24\ \text{mm}^2}{\pi}} + 2 * 1.2\ \text{mm} = 127.463\ \text{mm}$$

As another example, a comparison calculation can be made between the conventional gap bulk density (GBD) method of calculation and the inventive installed mat density (IMD) method of calculation for a construction having a mat weight of 47.64 grams, a mat length of 39.7 cm, a mat width $B_{mat}$ of 6.45 cm, a basis weight (BW) of 0.1860 g/cm$^2$, a target gap of 0.42 cm and a target cross-sectional gap area $A_{gap}$ of 16.18 cm$^2$ as follows:

Gap Bulk Density (linear based calculation) =

$$BW/\text{gap} = \frac{0.1860\ \text{g/cm}^2}{0.42\ \text{cm}} = 0.443\ \text{g/cm}^3$$

installed mat density (volume based calculation) =

$$\frac{m_{mat}}{(A_{gap} \times B_{mat})} = \frac{47.64\ \text{g}}{(16.18\ \text{cm}^2 \times 6.45\ \text{cm})} 0.457\ \text{g/cm}^2$$

Figure 5:
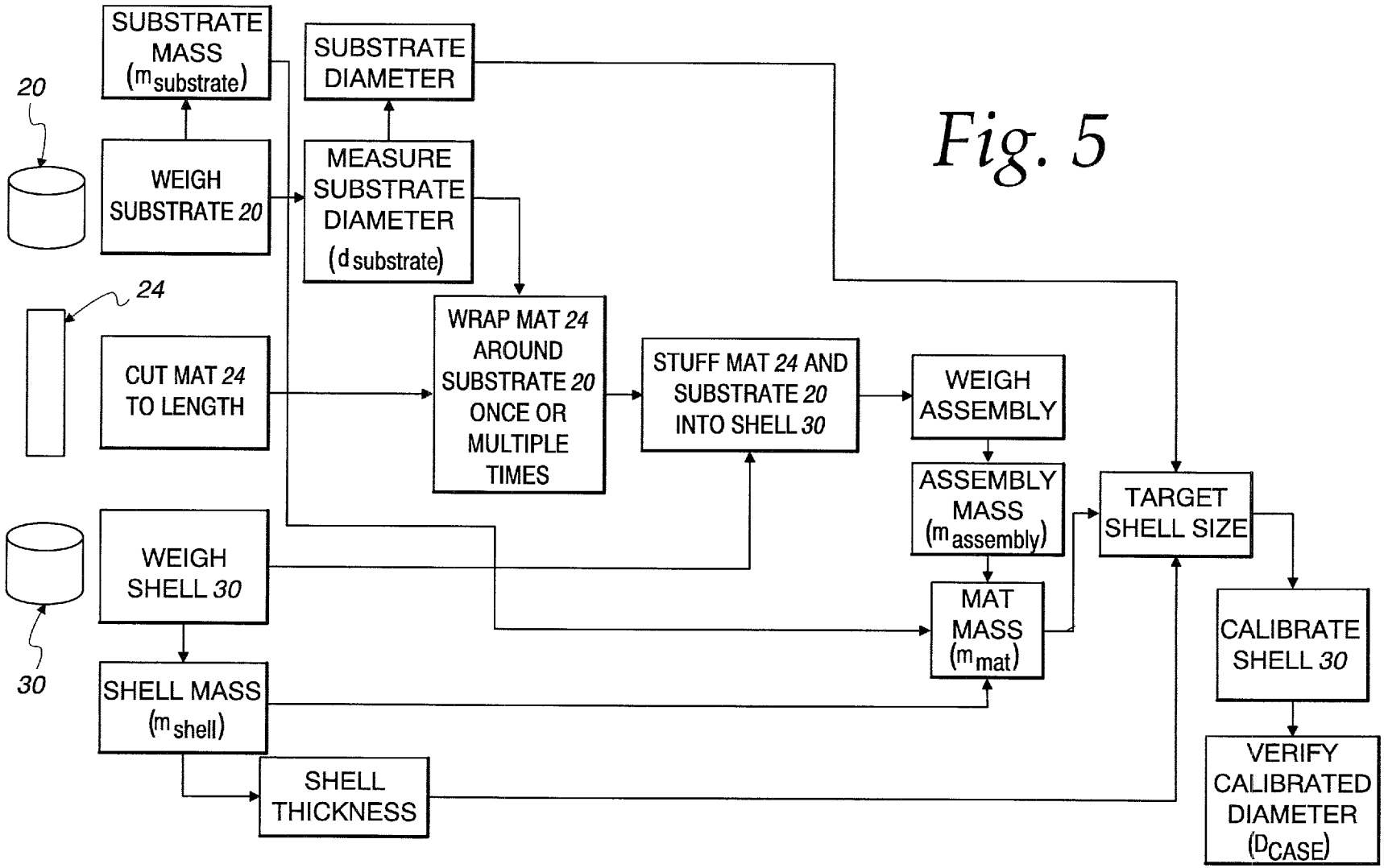
FIG. 5 is a diagrammatic representation of a process for determining the mass of a support mat and for assembling a catalytic unit including the support mat according to the invention.
Figure 6A:
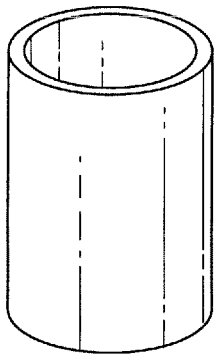
FIGS. 6*a*-6*b* show an example of a shell for the catalytic unit, with FIG. 6*a* being a perspective view and FIG. 6*b* being an end view.
Figure 6B:
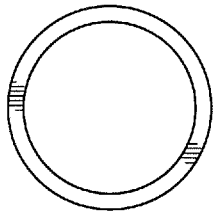
Figure 7A:
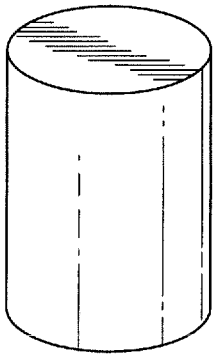
FIGS. 7*a*-7*b* show an example of a catalytic carrier for the catalytic unit, with FIG. 7*a* being a perspective view and FIG. 7*b* being an end view.
Figure 7B:
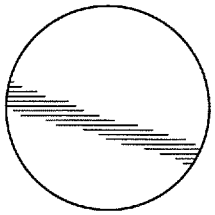
Figure 8A:
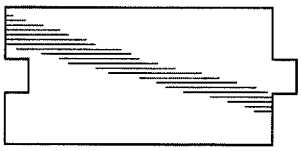
FIGS. 8*a*-8*b* show an example of a single layer support mat for the catalytic unit, with FIG. 8*a* being a plan view of the mat in a flattened state and FIG. 8*b* being a perspective view of the mat in a wrapped state.
Figure 8B:
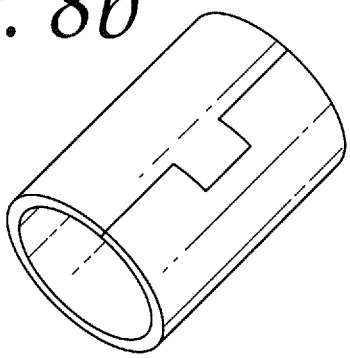

With reference to FIG. 5, a canning process is shown wherein the mass/weight $m_{mat}$ of the support mat 24 used in the assembled unit 10 is determined indirectly by first weighing both the carrier or substrate 20 and the shell 30 before assembly, then weighing the assembled unit 10 after the substrate 20, support mat 24, and shell 30 have been assembled, and determining the weight of the support mat 24 by subtracting the weight of the shell 30 and the weight of the substrate 20 from the weight of the assembled unit 10 ($m_{mat}=m_{assembly}-m_{shell}-m_{substrate}$). The mass/weight $m_{mat}$ of the support mat 24 is then utilized to calculate a target shell size $D_{case}$. In this regard, the target shell size $D_{case}$ can be calculated based upon a target gap, a target gap bulk density (GBD), or a target installed mat density (IMD).

As best seen in FIG. 3, in one preferred embodiment, the leading and trailing edges 50 of the support mat 24 are cut at an angle, rather than being cut perpendicular, in order to create a more gentle transition in the area where the edges 50 underlay or overlay an adjacent layer 22 of the support mat. In addition to providing a more gentle transition, this structure tends to fill an air gap that would be created by a perpendicular cut according to conventional methods. This reduces the variation in density that would otherwise be associated with such an air gap.

Additionally, the number of layers 22 in the wrap is preferably selected to minimize the decrease in density in the underlap/overlap areas to ensure that the density is sufficient to prevent problems with erosion. It will be appreciated that, in general, the greater number of layers 22 in the wrap, the less effect on density there is in the underlap/overlap areas. In this regard, the upper limitation on the number of layers 22 in a wrap will be dependent upon the fragility of the material of the support mat and upon the cycle time of the unit. In one preferred embodiment, there are four layers 22 in the wrap.

As another option for determining the weight $m_{mat}$ of the support mat 24, during the initial production of the bulk roll 40, the weight of the spindle 39 is determined and subtracted from the total weight of the combined spindle 39 and roll 40 to provide a weight for the support mat on the roll 40. This weight is then divided by the total length of support mat on the roll 40 and the by the width W of the support mat on the roll 40 to provide an average bulk weight for the roll 40 in weight/area. The weight of each individual support mat 24 for any particular assembly 10 would then be determined by multiplying this average bulk weight by the width and length of the mat 24. In situations where each support mat 24 is cut to a fixed length for a particular construction of the unit 10, the shell outer diameter $D_{case}$ could then be fixed based on an initial calculation for all of such units 10 manufactured from a roll 42.

The invention claimed is:

1. A method of achieving an installed mat density (IMD) in a catalytic unit having at least one layer of support mat sandwiched between a catalyst carrier and a shell, the mat having a weight $m_{mat}$ and a width $B_{mat}$, the catalyst carrier having a cross-sectional area $A_{substrate}$, the method comprising the steps of:

calculating a desired annular cross-sectional area $A_{gap}$ of a gap between the catalyst carrier and the shell based on the following calculation:

$$A_{gap} = \frac{m_{mat}}{IMD * B_{mat}}$$

calculating a target cross-sectional area $A_{case}$ for an inside diameter of the shell based on the following calculation:

$$A_{case}=A_{substrate}+A_{gap}$$

calibrating the shell by altering the inside diameter of the shell to achieve the calculated $A_{case}$ after the catalyst carrier and support mat are assembled into the shell.

2. The method of claim 1 wherein $m_{mat}$ is determined by weighing the shell before assembly with the catalyst carrier and the support mat, weighing the catalyst carrier before assembly with the shell and the support mat, weighing the assembled shell/mat/catalyst carrier, and then calculating the weight $m_{mat}$ by subtracting the weight of the shell and the weight of the catalyst carrier from the weight of the assembled shell/mat/catalyst carrier.

3. The method of claim 1 wherein $m_{mat}$ is determined by finding the total weight of support mat on a bulk roll of support mat from which the support mat for the catalytic unit is to be cut, dividing the total weight by the width of the bulk roll and the total length of the support mat on the bulk roll to provide an average bulk weight of the support mat of the bulk roll in weight/area, and then multiplying the average bulk weight by the width and length of the support mat.

4. The method of claim 1 wherein:

a calibrated outside diameter $D_{case}$ is calculated using the following equation:

$$D_{case} = \sqrt{\frac{4(A_{case} + A_{uncalibrated})}{\pi}}$$

where $A_{uncalibrated}$ is an uncalibrated annular cross-sectional area defined between an uncalibrated inside diameter of the shell and an uncalibrated outside diameter of the shell; and the calibrating step comprises reducing the uncalibrated outside diameter of the shell to the calibrated outside diameter $D_{case}$.

5. The method of claim 1 wherein the mat is free of binder.

6. A method of assembly catalytic units, each catalytic unit including a shell, a catalyst carrier, and a multi-layer support mat sandwiched between the shell and the catalyst carrier, the method comprising the steps of:

providing a bulk roll of support mat having a width extending parallel to a central axis of the roll;

slitting the bulk roll to form a plurality of end unit specific mat rolls with each end unit specific mat roll having a width that is specific to a particular configuration of catalytic unit; and cutting desired lengths of support mat from each of the end unit specific mat rolls and assembling the lengths of support mat into the particular configuration of catalytic unit corresponding to the end unit specific mat roll from which the length of support mat is cut;

further comprising the steps of:

calculating a desired annular cross-sectional area $A_{gap}$ of a gap between the catalyst carrier and the shell based on the following calculation:

$$A_{gap} = \frac{m_{mat}}{IMD * B_{mat}}$$

where $m_{mat}$=support mat weight $B_{mat}$=support mat width;

calculating a target cross-sectional area $A_{case}$ for an inside diameter of the shell based on the following calculation:

$$A_{case}=A_{substrate}+A_{gap}$$

where $A_{substrate}$=cross sectional area of the catalyst carrier; and calibrating the shell to achieve the calculated $A_{case}$ after the catalyst carrier and support mat are assembled into the shell.

* * * * *